United States Patent [19]

Jamieson et al.

[11] 4,050,981

[45] Sept. 27, 1977

[54] PROCESS FOR THE DELIGNIFICATION OF LIGNOCELLULOSIC MATERIAL BY MAINTAINING A CONCENTRATION OF CARBON MONOXIDE IN THE PRESENCE OF OXYGEN AND ALKALI

[75] Inventors: Allan Geoffrey Jamieson, Ornskoldsvik; Hans Olof Samuelson, Goteborg; Leif Åke Smedman, Domsjo; Kent Ivar Sondell, Ornskoldsvik, all of Sweden

[73] Assignee: Mo och Domsjo Aktiebolag, Ornskoldsvik, Sweden

[21] Appl. No.: 586,114

[22] Filed: June 11, 1975

[30] Foreign Application Priority Data

June 14, 1974 Sweden ..... 7407885
Jan. 22, 1975 Sweden ..... 7500686

[51] Int. Cl.[2] ..... D21C 3/02; D21C 9/02; D21C 9/14; D21C 11/06

[52] U.S. Cl. ..... 162/37; 162/40; 162/60; 162/63; 162/65; 162/79

[58] Field of Search ..... 162/63, 65, 79, 60, 162/37, 40

[56] References Cited

U.S. PATENT DOCUMENTS

| | | | |
|---|---|---|---|
| 1,790,260 | 1/1931 | Cable | 162/63 |
| 2,811,518 | 10/1957 | Mitchell et al. | 162/65 |
| 3,525,665 | 8/1970 | Gessner | 162/65 |
| 3,764,464 | 10/1973 | Samuelson | 162/65 |
| 3,790,637 | 2/1974 | Yam | 162/65 |

FOREIGN PATENT DOCUMENTS

| | | | |
|---|---|---|---|
| 2,022,866 | 12/1970 | Germany | 162/65 |
| 1,954,267 | 6/1970 | Germany | 162/65 |
| 372,305 | 3/1973 | U.S.S.R. | |

OTHER PUBLICATIONS

Kratzl et al., "Model Experiments on Oxygen Bleaching of Pulp (1) Formation of Carbon Monoxide from Carbohydrates, Sugar Alcohols, and Phenols", Holzforshung 28, No. 3, 77–81, June 1974, ABIPC vol. 45, No. 8.

Larducci et al, "Influence of Transition Metals in Oxygen Pulping", TAPPI, vol. 50, No. 2, Feb. 1975, 162–165.

*Primary Examiner*—S. Leon Bashore
*Assistant Examiner*—Steve Alvo

[57] ABSTRACT

Process for improving the selectivity of delignification of lignocellulosic material in the presence of oxygen gas and alkali by maintaining a carbon monoxide content in the gas phase within the range from about 1% to about 12% by volume. The carbon monoxide concentration is maintained by withdrawing carbon monoxide and oxygen gas from the delignification, and separating and recycling withdrawn oxygen gas.

37 Claims, 1 Drawing Figure

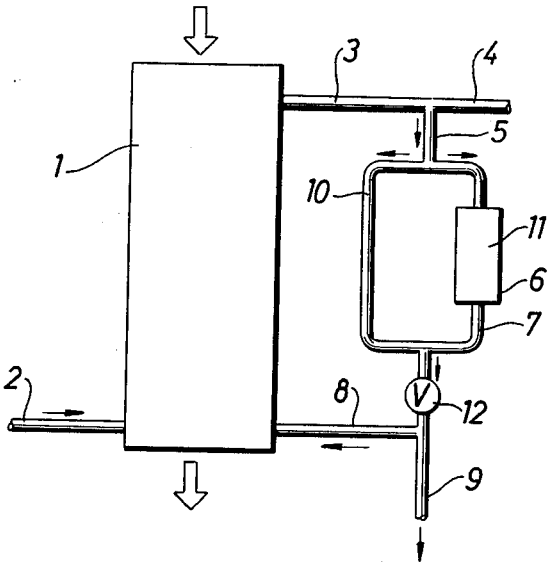
1
2
3
4
5
6
7
8
9
10
11
12
V

PROCESS FOR THE DELIGNIFICATION OF LIGNOCELLULOSIC MATERIAL BY MAINTAINING A CONCENTRATION OF CARBON MONOXIDE IN THE PRESENCE OF OXYGEN AND ALKALI

The conversion of raw lignocellulosic material to unbleached and then to bleached pulp requires an extremely complex and intricate series of chemical reactions and physical processing, usually requiring two or more stages in which different reactions are involved. The first is referred to as pulping, and the second as bleaching. Both however include delignification.

Rydholm in *Pulping Processes* has pointed out that the common purpose of all chemical pulping processes is to achieve fiber liberation by delignification, and they can be classified according to their different ways of achieving this. Reactions with the carbohydrates occur at the same time, and dissolution of certain amounts of the carbohydrates and chemical modification of the remainder determine the quality of both dissolving and paper pulps, and are therefore controlled accordingly. Dissolution of the extraneous components of wood is important to pulp quality. Inorganic side reactions occur, which are of importance not only for the regeneration of the pulping chemicals, but indirectly for the reactions with the wood during the cook.

Alkaline delignification results in alkaline hydrolysis of the phenolic ether bonds, whereby lignin is rendered soluble in alkali. Sulfidation by hydrosulfide in the Kraft process may both accelerate the cleavage of phenolic ether bonds and cause direct cleavage of alkyl ether bonds, as well as protect alkali-sensitive groups from a condensation which could retard the delignification. Sulfonation of benzyl alcohol and alkyl ether groups in the sulfite process renders the lignin water-soluble; the cleavage of the alkyl ether bonds, which keep the initially formed lignosulfonates bound to the wood, occurs by sulfitolysis or acid hydrolysis. At the same time sulfonation of the reactive groups prevents their partaking in condensation reactions. Neutral sulfite pulping, which involves less delignification, utilizes sulfonation of certain groups in the lignin to hydrophilic sulfonates, the dissolution of which is effected by unknown reactions, which may involve both sulfitolysis and hydrolysis. Finally, nitration and chlorination of lignin, used in some minor pulping processes, together with some oxidation, as in oxygen-alkali pulping, cause changes at the aromatic nuclei of lignin, which lead to decomposition of the lignin macromolecules to smaller fragments, soluble in water or alkali.

In all delignification, one side reaction of lignin is most undesirable, its self-condensation, which occurs in both acid and alkaline medium, rendering the lignin less soluble and dark in color, which darkens the color of the pulp. Chemical pulping cannot entirely avoid lignin condensation, and the lignin remaining in the pulp after cooking is more or less condensed. The purpose of the bleaching reactions is to cause such degradation of these lignin molecules that they can be dissolved, and thus improve the color of the pulp.

Although in most pulp uses lignin is an undesirable or at best inert component of the pulp, no preparation of unbleached pulp aims at complete delignification. This is primarily because of the unavoidable reactions with the carbohydrates during the delignification. These reactions become particularly serious towards the end of the cook, when the rate of delignification is slow, because of the small amounts of lignin remaining and their high degree of condensation or inaccessibility. When pulps with a high content of hemicellulose are desired, considerable amounts of lignin are left in the pulp. For unbleached pulps the upper limits are set by the brightness and brightness stability required, as well as the extent to which lignin can be allowed to impair the beating and strength properties of the pulp. In the case of bleached pulps the cost of bleaching agents is the limiting factor.

The alkaline degradation of carbohydrates starts at the aldehydic end groups and proceeds along the chains in a sort of peeling reaction with conversion of the sugar monomers to saccharinic and other hydroxy acids. This reaction occurs fairly rapidly at 100° C and therefore precedes delignification. At higher temperatures there occurs a direct alkaline hydrolysis of the glycosidic bonds, which also affects the more crystalline parts of the carbohydrates. This reaction not only leads to new losses of yield by peeling reactions starting at the freshly formed aldehydic groups, but also to a shortening of the cellulose chains and a deterioration of the strength properties of the pulp. Another reaction, involving an intramolecular rearrangement, causes a stabilization of the carbohydrate molecules under formation of a carboxyl end group.

The selectivity of the pulping chemicals with respect to delignification determines the yield of the pulping process and to some extent the pulp properties. In the sulfite process, sulfonation and acid hydrolysis contribute to delignification, and acid hydrolysis to the carbohydrate degradation and dissolution. In the Kraft process, sulfidation and alkaline hydrolysis contribute to delignification, and alkaline peeling and hydrolysis to the carbohydrate degradation. The delignification proceeds more rapidly in the sulfite cook than in the Kraft cook, and lower temperatures can therefore be used in the former, which is fortunate because the hydrolysis of the glycosidic bonds of the carbohydrates occurs much more rapidly in acidic than in alkaline medium. Alkaline peeling reactions, on the other hand, require lower temperature than the alkaline delignification, and they unavoidably decrease the carbohydrate yield, to a degree which depends on both chemical and physical changes in their structure. Accessibility phenomena improve the selectivity of lignin removal.

It is a consequence of the above phenomena that the rate of pulping is governed mainly by the rate of delignification. Of the delignification reactions mentioned above, chlorination is most rapid and occurs at a technically acceptable rate also at room temperature. Nitration is somewhat slower, but can be performed at temperatures below 100° C without overlong reaction times. However, the remaining reactions, which involve the least expensive chemicals and are accordingly the most important, unfortunately require elevated temperatures and pressures to proceed sufficiently rapidly. This causes an expensive heat consumption, expensive pressure vessel constructions, and difficulties in the construction of continuously operating machinery because of the problem of feeding chips against a reaction zone of elevated pressure.

These problems naturally have led to investigation of possible additives such as inhibitors and catalysts which improve control of the reactions concerned.

Autooxidation reachions are known to be catalyzed by small quantities of compounds of the transition metals, such as copper, cobalt and iron. Pradt el al Swedish Utlaggningsskrift No. 73 01518-2, published Aug. 7, 1973, indicate that the rate of delignification of wood using oxygen and alkali could be increased in the presence of a copper salt as a catalyst. It has however been demonstrated (*Svensk Papperstidning* 76 480-485(1973) that the addition of copper salts using either wood powder or wood chips results in a severe degradation of the cellulose, which in turn gives a lower viscosity of the cellulose at a given lignin content and a given Kappa number (referred to generally as an impaired selectivity).

When lignin is oxidized under certain strongly alkaline conditions, carbon monoxide is often formed. If the oxidation is carried out in the presence of oxygen gas, there is as a result a considerable danger that an explosive mixture will from, because mixtures of oxygen and carbon monoxide in certain proportions are highly explosive. In addition, carbon monoxide is quite poisonous. Thus the formation of carbon monoxide in the course of lignin oxidation ought to be avoided, particularly in the case of the delignification of lignocellulosic material by oxygen and alkali, by controlling the conditions so that the formation of carbon monoxide is inhibited or entirely prevented. This can be done, for example, by using mildly alkaline conditions, with alkali metal carbonate and/or bicarbonate as the source of alkali, alone or in admixture with alkali metal hydroxide. In this event the amount of carbon monoxide is less than 1% by volume. When the formation of carbon monoxide is unavoidable, as under some conditions in this delignification process, a proportion of the gas phase is withdrawn from the system from time to time, in order to prevent the formation of an explosive mixture as the carbon monoxide concentration builds up. Some carbon dioxide may also be formed and is vented with the carbon monoxide and oxygen during the process.

In accordance with the invention, it has now been determined that carbon monoxide is certain limited proportions, but in larger amounts than is normally present or formed in situ in a batch process, has an important beneficial effect on the selectivity of delignification of lignocellulosic material with oxygen gas and alkali at elevated temperatures and elevated pressures, since the carbon monoxide has an inhibiting effect on the decomposition of carbohydrates. The term "improved selectivity" as used herein accordingly refers to the noted decrease in decomposition of the carbohydrate material during delignification. This decrease is evidenced by comparing at the same lignin content the delignified materials obtained when the delignification is carried out in the presence of and in the absence of carbon monoxide. The lignin content of the delignified material is indicated by the Kappa number of the material. An improved selectivity provides a higher degree of polymerization, which is evidenced by a higher viscosity of the cellulose, at the same Kappa number. The higher viscosities are also accompanied by improved strength properties of the pulp and/or of paper prepared from such pulp.

In accordance with the invention, an improved selectivity is obtained in the delignification of lignocellulosic material by oxygen gas and alkali by carrying out the delignification in the presence of carbon monoxide, while maintaining the concentration of carbon monoxide present in the oxygen gas phase of the delignification system within the range from about 1% to about 12% by volume of the gas phase. This can be done while supplying oxygen gas in excess to the reaction system, either by adding or removing carbon monoxide from the oxygen gas phase, continuously or from time to time, so as to maintain the carbon monoxide content within the stated range.

At carbon monoxide concentrations below 1% by volume, the inhibiting effect on the decomposition of carbohydrates is not noticeable. At 1%, a slight inhibiting effect is obtained, and at amounts of 2% and more, the inhibiting effect can be quite satisfactory. An optimum inhibiting effect is obtained at amounts of 4% and higher.

The upper limit on carbon monoxide concentration is imposed by the explosion hazard of carbon monoxide-oxygen gas mixtures. In order to minimize the risk of explosion, the carbon monoxide concentration should not exceed 12% by volume and preferably is less than 10%. A safe maximum with optimum inhibiting effect is obtained in amounts up to 9%. If it is desired to increase the safety margin, and simplify operational control of the delignification system, the carbon monoxide concentration should be maintained within the range from about 4% to about 7% by volume. The maximum proportion of carbon monoxide that can be tolerated in the reaction mixture depends upon pressure and temperature, and the relative proportions of other gases, such as nitrogen, turpentine, methanol, hydrocarbons, acetone, and other flammable gases in the gas phase of the delignification system.

To provide an ample margin of safety, therefore, the carbon monoxide content of the gas phase should not at any time be greater than 90% of the concentration at the explosion limit of the gaseous mixture under the delignification temperature, pressure and gas component parameters of the delignification system. The explosion limits for systems containing carbon monoxide and oxygen gas are known, and are reported in the literature, particularly, in conventional engineering and chemical handbooks, and in the *International Critical Tables*, and they can be determined for any given delignification system, taking into account other gases which may be present.

The carbon monoxide concentration in the gas phase of the system can be monitored closely, and preferably continuously, using conventional carbon monoxide analysis techniques. Analytical instruments are conveniently connected to a recorder or printing apparatus, and also to alarms, which give a warning when the carbon monoxide concentration approaches the danger limit.

It is desirable to so arrange the delignification system that the limiting explosive ratio of carbon monoxide to oxygen cannot be reached locally in any part of the system. This is best determined for the particular system to be employed by trail-and-error experimentation, using conventional analytical techniques. If a delignification system has recently been shut down and cleaned, for example, using volatile and flammable solvents, such solvent concentrations must be taken into account when the system is started up again, and the concentration of carbon monoxide in the gas phase controlled accordingly. It may be advisable, for instance, to maintain the carbon monoxide concentration during the first few runs following shut-down and cleaning at no more than half the concentration of carbon monoxide at the explosive ratio.

In order to prevent local concentrations beyond the explosive limit of carbon monoxide, it is desirable to circulate either the gas, or the lignocellulosic material being delignified, or both. Either countercurrent or concurrent flow thereof can be applied, in a continuous delignification system, or even in a batch system. Stirring of the contents of the reaction vessel can also be used.

The method of maintaining carbon monoxide concentration uniform is to withdraw and then recycle the gas phase of the delignification system. Before recycling, such gas is processed to remove carbon monoxide, by conversion to carbon dioxide, or by adsorption, absorption, or other means. This makes it possible to recover the oxygen that necessarily is removed with the carbon monoxide, and which is important economically. Carbon monoxide also may be removed from the gas phase by means of semipermeable films porous to carbon monoxide, or by molecular sieve techniques.

Usually, however, the simplest and most economical method is to convert the carbon monoxide to carbon dioxide by oxidation. The resulting carbon dioxide can be permitted to remain in the system, or can be removed in whole or in part and used elsewhere, for example, in forming sodium bicarbonate and carbonate from caustic regenerated from spent pulping or bleaching liquors. Carbon dioxide can be removed by absorption in an alkaline-reacting liquid, or in the residual alkali in the pulp, or by chilling, or by other known methods. When carbon monoxide is removed from gas withdrawn from the delignification system, other volatile combustible substances, such as turpentine and terpenes, can be removed at the same time, before recycling.

Conversion of carbon monoxide to carbon dioxide is preferably carried out by a catalytic oxidation, in which the gas containing oxygen and carbon monoxide is passed in contact with an oxidation catalyst. Suitable catalysts are platinum catalysts on an inert carrier such as alumina. Such catalysts are available commercially, under the trade names DEOXO R and COEX 0.3. The oxidation of carbon monoxide can be carried out at a temperature within the range from about 75° to about 200° C. Volatile organic compounds such as methanol, turpentine and acetone can be oxidized at the same time, or separately.

It is also possible to utilize the withdrawn gas phase containing oxygen and carbon monoxide as the oxygen gas phase, in whole or in part, in the delignification of another portion of lignocellulosic material, in a different or parallel delignification system. Such gas can for instance be a source of carbon monoxide in the start-up of the system before delignification reactions build up a sufficient carbon monoxide concentration in situ, to maintain the carbon monoxide concentration within the desired range ab initio.

Thus, the delignification system of the invention can serve as an oxygen alkaline gas digestion as well as an oxygen alkaline gas bleaching process. The two stages can conveniently be combined using the gas phase recycled from the bleaching stage to the digestion stage. Relatively large amounts of carbon monoxide are formed in the course of bleaching, using sodium hydroxide as the active alkali. The amount of carbon monoxide is in proportion to the decrease in the Kappa number. During the bleaching of a pine sulphate pulp, for example, there is formed 0.03% by weight carbon monoxide, calculated on the ingoing dry pulp, while the Kappa number is reduced from 30 to 15.

Consequently, such a gas phase after bleaching can be transferred to a digester for digestion of lignocellulosic material, and bring the carbon monoxide concentration there to within the stated range needed for good selectivity in accordance with the invention. This is particularly desirable when the oxygen gas digestion process is effected using alkali carbonate or bicarbonate. When alkali metal carbonate or bicarbonate is used as the alkali in such an oxygen gas-alkali delignification, it may be difficult to obtain and maintain a sufficiently high concentration of carbon monoxide during the delignification, because the amount of carbon monoxide formed during the delignification is so small as to give no noticeable inhibiting effect. Using a higher carbon monoxide concentration within the range stated in the oxygen gas-alkali digestion, excellent selectivity is obtained.

The carbon monoxide is especially beneficial when used in combination with manganese compounds, in which case an improved selectivity is obtained, as well as a more rapid delignification reaction. It is accordingly preferred in accordance with the invention to carry out the delignification process in the presence both of carbon monoxide and of added manganese compounds in the delignification liquor. In this case, the pH of the delignification liquor is within the range from about 6.5 to about 11, and preferably within the range from about 7 to about 9.5.

There is at present no method available which permits a determination of pH inside a digester or bleaching reactor at the prevailing high pressure and high temperature. Theoretically, the pH is determined by the concentration of dissolved carbon dioxide in the cooking liquor and the concentration of active alkali. Consequently, in accordance with the invention, pH is determined on liquor samples withdrawn from the digester through a cooler, without release of pressure so that the $CO_2$ dissolved in the liquor remains in the sample and thus brought to room temperature, using a glass electrode. If the pH is taken on a sample having a pH of about 9 or less and withdrawn from the reactor without cooling, dissolved $CO_2$ is lost to the atmosphere, and the pH is the sample is erroneously higher, often more than one unit higher than that determined on cooled samples.

In accordance with the invention, it has now been determined that for optimum effect on the selectivity of the delignification, the manganese compound and the carbon monoxide should be present at the start of the delignification, or at an early stage of the delignification, and before dissolution of approximately 10% of the lignin content of the starting lignocellulosic material.

Some types of lignocellulosic material contain manganese compounds. At least a proportion of such manganese compounds apparently is locked in, in an inactive noncatalytic form, however, unable to catalyze delignification to a noticeable extent. The delignification of such manganese-containing lignocellulosic material is also improved, in accordance with the invention, by adding catalytically active manganese compounds, i.e., manganese compounds capable of supplying manganese to the delignification reaction in a catalytic form, in which possibly manganese ion is provided in solution in the alkaline delignification liquor in an active condition. Such added manganese in active form catalyzes the delignification, increasing the rate of delignification, and improves selectivity, as shown by a higher viscosity at a given Kappa number of the resulting pulp, whether bleached or unbleached.

In a preferred embodiment of the invention, the lignocellulosic material prior to the oxygen-alkali delignification is treated so as to remove at least a major proportion and preferably substantially all of the catalytically active metal ion or compounds that may be present with the material, such as copper, iron and cobalt. Such removal enhances the protection exerted by the carbon monoxide and by any manganese compound present in the course of delignification and results in a synergistic retarding effect of the carbon monoxide and added manganese on the depolymerization of the cellulose.

The manganese compound can be added initially in a sufficient amount, or incrementally or continuously in the course of the delignification, together with or separately from incrementally or continuously added alkali. Such supplemental addition of manganese may be desirable in order to maintain a suitable concentration of active manganese compounds throughout the delignification.

It is also suitable to carry out the delignification in one or more stages, at varying pH's in the course of each stage, and active manganese compounds can be added to the delignification reaction mixture in one, or several, or all of these stages.

The added manganese compounds employed in the process of the invention provide manganese in catalytically active form to the delignification. For this purpose, the manganese should be preferably in a form which provides bivalent manganese. The anion with which the added manganese is associated can be inorganic or organic, and the added manganese can also be associated in a complex which provides a proportion of manganese.

Exemplary bivalent manganese compounds include manganous oxide, manganous chloride, manganous bromide, manganous hydroxide, manganous nitrate, manganous sulfate, manganous carbonate, manganous phosphate, manganous acetate, manganous formate, manganous oxalate, and complex salts of manganous ion with chelating inorganic and organic acids.

Aliphatic alpha-hydroxycarboxylic acids of the type RCHOHCOOH and the corresponding beta-hydroxycarboxylic acids $RCHOHCH_2COOH$ have the property of forming chelates with manganese.

Exemplary alpha- and beta-hydroxy carboxylic acids are glycolic acid, lactic acid, glyceric acid, $\alpha,\beta$-dihydroxybutyric acid, $\alpha$-hydroxybutyric acid, $\alpha$-hydroxyisobutyric acid, $\alpha$-hydroxy-n-valeric acid, $\alpha$-hydroxyisovaleric acid, $\beta$-hydroxyisobutyric acid, $\beta$-hydroxyisovaleric acid, erythronic acid, threonic acid, trihydroxyisobutyric acid, and sugar acids and aldonic acids, such as gluconic acid, galactonic acid, talonic acid, mannoic acid, arabonic acid, ribonic acid, xylonic acid, lyxonic acid, gulonic acid, idonic acid, altronic acid, allonic acid, ethenyl glycolic acid, and $\beta$-hydroxyisocrotonic acid.

Also useful are organic acids having two or more carboxylic groups, and no or from one to ten hydroxyl groups, such as oxalic acid, malonic acid, tartaric acid, malic acid, and citric acid, ethyl malonic acid, succinic acid, isosuccinic acid, glutaric acid, adipic acid, suberic acid, azelaic acid, maleic acid, furamic acid, glutaconic acid, citramalic acid, trihydroxy glutaric acid, tetrahydroxy adipic acid, dihydroxy maleic acid, mucic acid, mannosaccharic acid, idosaccharic acid, talomucic acid, tricarballylic acid, aconitic acid, and dihydroxy tartaric acid.

Manganese complexes of nitrogen-containing polycarboxylic acids are especially effective inhibitors. Several important acids belonging to this group have the formula:

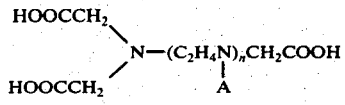

or alkali metal salts thereof, in which A is the group—$CH_2COOH$ or —$CH_2CH_2OH$, where $n$ is an integer from zero to five. The mono, di, tri, tetra, penta and higher alkali metal salts are useful, according to the available carboxylic acid groups converted to alkali metal salt from.

Examples of such compounds are ethylene diamine tetraacetic acid, ethylene diamine triacetic acid, nitrilotriacetic acid, diethylene-triaminopentaacetic acid, tetraethylenepentamine heptaacetic acid, and hydroxyethylene diamine triacetic acid, and their alkali metal salts, including the mono, di, tri, tetra and penta sodium, potassium and lithium salts thereof. Other types of aminocarboxylic acids which can be used to advantage are iminodiacetic acid, 2-hydroxyethyliminodiacetic acid, cyclohexanediamine tetraacetic acid, anthranil-N, N-diacetic acid, and 2-picolylamine-N,N-diacetic acid.

These complexing agents can be present in rather large quantities, within the range from about two to about ten times the amount needed to prevent precipitation of manganese compounds during the impregnation of the lignocellulosic material with manganese. The use of waste pulping or bleaching liquor in combination with complexing agens of this type is particularly advantageous.

The polyphosphoric acids are also good complexing agents for manganese, and the manganese salts of these acids are useful in the process of the invention. Exemplary are disodium manganous pyrophosphate, trisodium manganous tripolyphosphate and manganous polymetaphosphate.

Especially advantageous from the standpoint of cost are the acids naturally present in waste liquors obtained from the alkaline treatment of cellulosic materials. These acids presents the alkali- or water-soluble degradation products of polysaccharides which are dissolved in such liquors, as well as alkali- or water-soluble degradation products of cellulose and hemicellulose. The chemical nature of these degradation products is complex, and they have not been fully identified. However, it is known that saccharinic and lactic acids are present in such liquors, and that other hydroxy acids are also present. The presence of $C_6$-isosaccharinic and $C_6$-metasaccharinic acids has been demonstrated, as well as $C_4$- and $C_5$-metasaccharinic acids. Glycolic acid and lactic acid are also probable degradation products derived from the hemicelluloses, together with beta, gamma-dihydroxy butyric acid.

Carbohydrate acid-containing cellulose waste liquors which can be used include the liquors obtained from the hot alkali treatment of cellulose; liquors from sulfite digestion processes; and liquors from sulfate digestion processes, i.e., Kraft waste liquor. The waste liquors obtained in alkaline oxygen gas bleaching processes, for example, those disclosed in U.S. Pat. Nos. 3,652,385 and 3,652,386, or alkaline peroxide bleaching processes can also be used. In this instance, the alkaline liquor can be taken out from the process subsequent to completing the oxygen gas delignification or during the actual delignification process.

The complex manganese salts can be formed first, and then added to the lignocellulosic material. They can also be formed in situ from a water-soluble or water-insoluble manganous salt, oxide or hydroxide, in admixture with the complexing acid, and this mixture can be added to the lignocellulosic material. Preferably, the waste liquor employed as the source of complexing acid or lactone or salt thereof can be mixed with a manganous salt, oxide or hydroxide, before being introduced to the process. It is also possible to add the manganous salt, oxide or hydroxide to the delignification liquor, and then bring the liquor into contact with the complexing acid or lactone or salt thereof. It is also possible to combine the complexing acid or lactone or salt thereof with the liquor and then add the manganous salt, oxide or hydroxide, but this method may be less advantageous in practice.

Manganese compounds providing manganese ion in a higher valence state, such as trivalent or tetravalent manganese, can be used, but may lead to the production of pulp having an impaired brightness. Exemplary higher polyvalent manganese compounds include manganic chloride, manganic nitrite, manganic sulfate, manganic carbonate, manganic acetate, manganic formate and manganic oxalate, and complex salts of manganic ion with any of the chelating acids mentioned above.

It is not understood why the addition of manganese has a different effect upon the course of the delignification than manganese which is already present in the lignocellulosic material.

It has not been possible to determine the form of catalytic manganese present in the delignification reaction system, nor has it been possible to distinguish between active manganese and inactive manganese in this system by analytical methods. For this reason, analysis of the lignocellulosic material for manganese content is not revealing. All that is known is that the manganese must be added in a catalytic form, and that it should be freshly added, for optimum effect. Consequently, throughout the specification and claims, reference to manganese in active from or in catalytic form is a reference to such manganese compounds.

In whatever from manganese is added, whether as salt, oxide, hydroxide, or complex salt, the amount of manganese is calculated as Mn.

The quantity of manganese compounds added to the system is selectted according to the nature of the starting material, and the desired quality of the delignified product.

Amounts within the range from about 0.003 to about 0.5% by weight of the dry lignocellulosic material give good results. Beneficial effects may be observed at 0.001% by weight of the dry lignocellulosic material. Optimum results have been obtained at amounts within the range from about 0.05 to about 0.5%. Amount in excess of 0.5%, up to 1% or 2%, may not afford any better effect under normal conditions, and may result in an impaired brightness, but such amounts can be used.

The oxygen-alkali delignification process in accordance with the invention is applicable to the digestion of any kind of lignocellulosic material, such as bagasse, straw, jute, and particularly wood.

The delignification process of the invention is applicable in the digestion of any kind of wood. In general, hardwood such as beech and oak can be pulped more easily than softwood, such as spruce and pine, but both types of wood can be pulped satisfactorily using this process. Exemplary hardwoods which can be pulped include birch, beech, poplar, cherry, sycamore, hickory, ash, oak, chestnut, aspen, maple, alder and eucalyptus. Exemplary softwoods include spruce, fir, pine, cedar, juniper and hemlock.

The lignocellulosic material should be in particulate form. Wood chips having dimensions that are conventionally employed in pulping processes can be used. However, appreciable advantages with respect to uniformity of the delignification process under all kinds of reaction conditions can be obtained if the wood is in the form of nonuniform fragments of the type of wood shavings or chips having an average thickness of at most 3 mm, and preferably within the range from about 0.2 to about 2 mm. Other dimensions are not critical. Sawdust, wood flour, wood silvers and splinters, wood granules, and wood chunks, and other types of wood fragments can also be used.

The oxygen-alkali delignification process in accordance with the invention is also applicable to the delignification of unbleached cellulose pulp. The process can be used to advantage with wood pulp of any type, including mechanical pulp, but particularly chemical pulp and semichemical pulp. The chemical pulp can be prepared by any pulping process. Oxygen-alkali pulp, sulfate pulp and sulfite pulp are illustrative. The invention is applicable to cellulose pulps derived from any type of wood, such as spruce pulp, pine pulp, hemlock pulp, brich pulp, cherry pulp, sycamore pulp, hickory pulp, ash pulp, beech pulp, poplar pulp, oak pulp, and chestnut pulp.

The delignification process of the invention can also be carried out in conjunction with the oxygen delignification of, for example, defibrated wood, and wood which has first been subjected to a chemical treatment, for example a soda cooking operation, and subsequently defiberized. This latter method is sometimes referred to as an oxygen cooking process, although the oxygen bleaching of semi-chemical pulp is a better designation. Normally, an oxygen delignification process is continued, even when concerned with an oxygen cooking process, until the material is readily defiberized. Shives separated after the cooking and uncooked material can be returned to the process, or treated separately in accordance with known methods.

Prior to treatment by the process of the invention, the lignocellulosic material optionally but preferably is subjected to a pretreatment with water and/or an aqueous solution in one or more stages so as to remove metal ions or compounds thereof such as copper, cobalt and iron, and also manganese and any other metal ions which may be present. A pretreatment is especially advantageous in the case of hardwood chips.

Such metal ions or compounds may have a deleterious effect upon the delignification, and may also increase attack on the carbohydrates in the course of the delignification, due to a catalytic effect on the degradation reactions. Frequently, when such metal ions or compounds are allowed to remain during the delignification process of the invention, the result is a lower viscosity in the treated pulp, or a lower carbohydrate content thereof, or both, either or both of which may well be undersirable.

The pretreatment accordingly is carried out under conditions such that these metal ions or compounds are removed by dissolution in the treating liquor.

It is frequently possible to remove all or part of such metal ions or compounds by washing the lignocellulosic material with water. This results in the removal of water-soluble metal compounds by leaching or dissolution. An improved dissolution is obtained at elevated temperatures. The longer the washing time, the greater the proportion of metal ions or compounds that are extracted.

A suitable washing treatment is carried out using hot water at a temperature within the range from about 90° to about 160° C for from 0.1 to about 10 hours. In the course of the heat treatment in the presence of water, some of the lignocellulosic material is hydrolyzed to give organic acids which dissolve in the solution, for example acetic acid, and the resulting acid solution has an improved capacity for dissolution of metal ions or compounds present in the lignocellulosic material.

Aqueous acidic solutions containing organic and inorganic acids can also be used, such as acetic acid, citric acid, formic acid, oxalic acid, hydrochloric acid, sulphurous acid, sulphuric acid, nitric acid, phosphoric acid and sulphurous acid. Such solutions can have a pH within the range from about 1 to about 5, suitably from about 1.5 to about 4, and preferably from about 2 to about 3.5, with the contact continued for from about 0.1 to about 10 hours. Treatment with acidic aqueous solutions can be carried out at ambient temperatures, i.e., from about 10° to about 30° C, but elevated temperatures can also be used, ranging from about 40° to about 100° C. In the case of raw lignocellulosic materials, such as wood, such a treatment may be accompanied by hydrolysis of the cellulose, with the formation of additional acids.

However, when the delignification process of the invention is applied to paper pulp, it is usually desirable to avoid hydrolysis of the cellulose. In such cases, the time and temperature of the treatment together with the pH should be adjusted so that depolymerization of the carbohydrate material in the pulp is kept to a minimum.

With certain raw lignocellulosic materials, and particularly wood in particulate form, especially hardwood, it has been found advantageous to carry out the pretreatment with an aqueous alkaline solution, such as an alkali metal hydroxide or alkali metal carbonate or bicarbonate solution, for example, sodium hydroxide, sodium carbonate and sodium bicarbonate solution, the alkaline hydroxides or salts being used singly or in admixture.

Such an alkaline treatment is carried out preferably at an elevated temperature within the range from about 100° to about 200° C, suitably from about 120° to about 190° C, and preferably from about 140° to about 180° C, until there has been dissolved in the solution an amount of lignocellulosic material within the range from about 2 to about 40% by weight, suitably from about 5 to about 30% by weight, and preferably from about 5 to about 20% by weight, based on th dry weight of the lignocellulosic material. The treatment time can be within the range from about 0.1 to about 10 hours, suitably from about 0.25 to about 4 hours, and preferably from about 0.5 to about 2 hours.

A pretreatment of the lignocellulosic material with an aqueous sodium bicarbonate solution in the absence of oxygen is desirable to reduce the shives content of the resulting pulp. This process also removes a proportion of the iron and the amount of iron removed can be increased if a complexing agent is added to the sodium bicarbonate solution. Such a pretreatment can for example be carried out using an amount of sodium bicarbonate within the range from about 10 to about 20% based on the dry weight of the lignocellulosic material at a temperature within the range from about 130° to about 180° C for from about 0.5 to about 2 hours at a wood to pretreating liquor ratio of approximately 1:5.

Any carbon dioxide formed during the treatment is preferably vented, either continuously or from time to time.

Chelating or complexing agents for the metal ions to be removed can also be present. Such solutions have a superior extracting effect for the metal content of the lignocellulosic material. Any of the chelating acids referred to above in connection with the manganese complexes can be used. Exemplary complexing agents include the polyphosphates, such as pentasodium tripolyphosphate, tetrasodium pyrophosphate, and sodium hexametaphosphate; isosaccharinic acid, lactic acid, dihydroxybutyric acid and aldaric acid; and aminopolycarboxylic acids having the general formula

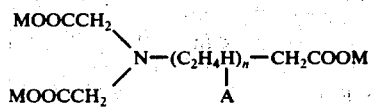

in which A is $CH_2COOH$ or $CH_2CH_2OH$ and $n$ is a number within the range from 0 to 5, and M is hydrogen, an alkali metal or ammonium.

Suitable chelating acids include ethylene diamine tetraacetic acid, nitrilotriacetic acid and diethylene triaminepentaacetic acid, as well as amines, particularly hydroxy alkyl amines such as mono-, di- and triethanolamine, and diamines, triamines and higher polyamines having complexing properties. Mixtures of these complexing and chelating agents can also be used, especially combinations of chelating agents that contain nitrogen with chelating agents that do not contain nitrogen.

Particularly useful are the metal complexing agents present in waste cellulose pulping, cellulose bleaching and other cellulose processing liquiors, which may be either alkaline or acidic. Such liquors as indicated above in conjunction with the manganese complexes normally contain complexing agents derived from the cellulose, as well as the complexing agents added for the purpose of the cellulose process from which the waste liquor is obtained.

Suitable waste liquors are for example waste pulping liquors, especially those from oxygen alkali pulping processes, and waste bleaching liquors, especially those from oxygen-alkali bleaching processes. Paticularly advantageous are liquors from oxygen-alkali delignification processes that contain complexing agents for cellulose degradation inhibitors. Used wash water from cellulose treatment processes also can be employed, including wash waters previously used for the pretreatment of earlier batches of lignocellulosic material treated by the process of the invention, as well as waste liquors from the delignification process of the invention.

Pretreatment liquors of different types can advantageously be combined or applied in sequence, as desired, for the greatest possible beneficial effect from different types of liquors. Thus, for example, in a first step a pretreatment may be effected with water containing dissolved sulphur dioxide having a pH of 2, at a temperature of 20° C, followed by treatment with an aqueous solution of sodium bicarbonate and sodium carbonate in the ratio of 7:3 (20% per weight based on dry wood) at 160° C for two hours in the presence of 0.1% diethylenetriamine pentaacetic acid, based on the dry weight of the lignocellulosic material.

Air may be injected into the pretreatment liquor under pressure; oxygen may also be introduced.

Whether or not a pretreatment is applied, it is desirable to wash the lignocellulosic material prior to the oxygen-alkali delignification process of the invention. Such washing of a pretreated lignocellulosic material makes it possible to remove residual traces of metal ions or compounds. The wash waters from this step can be returned to the pretreatment step.

The conditions under which the oxygen-alkali delignification process of the invention is carried out are selected to accommodate the lignocellulosic material being treated and the purposes for which its treatment product is to be used. Since the process is applicable both to raw lignocellulosic material and to pulped lignocellulosic material, which are chemically and physically quite different and nonequivalent materials, different delignification conditions may be desirable.

When applied in digestion of lignocellulosic materials, such as wood, the delignification in the presence of carbon monoxide and added manganese compounds in accordance with the invention can be carried out at a pH within the range from about 6.5 to about 11, and preferably within the range from about 7 to about 10. Optimum results are obtained if the pH is held within the range from about 7 to about 9.5 during the major part of the delignification.

It is important, as indicated previously, that pH be determined by measurements on a delignification liquor at ambient temperature, i.e., from 10° to 30° C. Consequently if the pH of a hot delignification liquor is to be determined, the liquor is cooled to ambient temperature before the pressure is released. This is necessary in order to obtain accurate and reporducible pH measurements.

The total amount of alkali that is required for the delignification when applied in digestion of lignocellulosic material such as wood, is determined by the quality and type of the pulp to be produced and is within the range from about 1 to 10 kilomoles per 1,000 kg. of dry wood. Cellulose pulps intended to be used in the production of regenerated cellulose fibers, such as viscose, acetate and cuprammonium pulps, are quite fully delignified, and should have a low content of lignin and hemicellulose. In the production of such pulps, in accordance with the process of the invention, the amount of alkali can be within the range from about 6 to about 8 kilomoles per 1,000 kg. of dry wood. Semichemical pulps are given an intensive mechanical treatment following their digestion in order to liberate the cellulose fibers, and in the production of such pulps using the process of the invention, the amount of alkali can be much less, within the range from about 1 to about 2 kilomoles per 1,000kg. of dry wood. For the production of bright paper pulp, which is readily defibered when the digester is blown, the amount of alkali used in the process of the invention can be within the range from about 2.5 to about 5 kilomoles. Generally, for most of the types of pulps given an intermediate degree of digestion, such as pulps for fine paper, plastic fillers, and soft paper or tissue paper, the amount of alkali in the process of the invention is within the range from about 2 to about 6 kilomoles per 1,000 kg. of dry wood.

Any alkali metal hydroxide or alkali metal carbonate can be employed, such as sodium hydroxide, potassium hydroxide, lithium hydroxide, sodium carbonate, potassium carbonate and lithium carbonate. The sodium carbonate obtained in the burning of cellulose digestion waste liquors can be used for this purpose. The use of alkali metal carbonates may be more advantgeous than the use of alkali metal hydroxides in maintaining the pH of the delignification liquor within the stated range, because of the buffering properties of the carbonate or bicarbonate present or formed in situ. Consequently, mixtures of alkali metal hydroxides and alkali metal carbonates are particularly satisfactory to obtain the advantages of each, and dilute their disadvantages. However, if alkali metal carbonate such as sodium carbonate is the sole alkali charge, the total amount of sodium is greater, and this imposes a greater load on the sodium recovery system.

The pH range suitable for delignification of wood in accordance with the invention can be obtained using as the alkali an appropriate mixture of alkali metal carbonate and/or bicarbonate, either or both of which may be admixed with alkali metal hydroxide in a minor proportion, to give a pH within the stated range. It is thus possible to use mixtures with alkali metal hydroxides or carbonates with alkali metal bicarbonates such as sodium bicarbonate and potassium bicarbonate. The alkali metal bicarbonate in the case serves as a buffer.

The amount of buffering agent such as alkali metal bicarbonate is usually within the range from about 1 to about 5 kilimoles per 1,000 kg. of dry wood. The alkali metal bicarbonate or other buffering agent should be added to the delignification liquor either initially or at an early stage of the delignification. The addition of the bicarbonate or other buffering agent increases the buffer capacity of the delignification liquor, thereby assisting in avoiding variations in pH outside the prescribed range during the delignification.

Large amounts of buffering agents, and particularly bicarbonates, should be avoided, however, since the presence of large amounts of additional foreign anions can be undesirable. In the case of bicarbonates, carbon dioxide may be produced in the course of the delignification as the buffer is consumed. The carbon dioxide dilutes the oxygen, and adds an extra load to the chemical recovery system, and is therefore undesirable in large amounts. However, the addition of minor amounts of the buffering agent within the stated range contribute to pulp uniformity because of their assistance in maintaining pH.

Also useful as a buffer are the base liquors from previous digestions and/or the waste liquors from oxygen bleaching processes, such as those described in U.S. Pat. Nos. 3,652,385 and 3,652,386. In this way, better economy is obtained in chemical recovery, which can be effected after evaporating and burning the waste digestion liquor, using known methods.

For economic reasons, the sodium compounds are preferred as the alkali metal hydroxide, alkali metal carbonate and alkali metal bicarbonate.

It is also possible to add the additional chemicals normally present in digestion liquors, such as sodium sulfide or other alkali metal sulfide. At most, such chemicals are added in an amount of about 1 kilomole per 1,000 kg. of dry wood.

Limiting the amount of alkali metal hydroxide and/or alkali metal carbonate in the initial stages of the process may be quite advantageous in obtaining a cellulose pulp of the desired quality. In the digestion of wood it is advantageous if at most 75% of the total molar quantity required of the alkali is added ab initio, and even this high percentage is only desirable if the pulp to be manufactured is a semichemical pulp, or if the wood has been pretreated with sulfur dioxide in aqueous solution. For most pulps, including even the semichemical pulps, a better cellulose pulp is obtained if the initial charge of alkali is within the range from about 2 to about 50% of the total molar quantity required for the delignification. The remainder of the alkali is added progressively, either incrementally or continuously, as the delignification continues. When producing bright pulps having a low lignin content, it is satisfactory to charge not more than 20% and suitably from about 5 to about 20% of the alkai at the beginning of the delignification process.

If a mixture of alkali metal hydroxide and alkali metal carbonate is used, it is particularly suitable if the initial charge comprises sodium carbonate, optionally with an addition of sodium bicarbonate as described above, the remainder of the alkali added as the delignification proceeds being sodium hydroxide. If the alkali charge initially is alkali metal hydroxide, it is usually important in producing pulps having a low lignin content that the initial charge be low, within the range from about 2 to about 10% of the total molar quantity of alkali.

Whether or not the delignification process is carried out continuously or as a batch process, the alkali metal hydroxide and/or alkali metal carbonate can be charged continuously or in increments to the delignification liquor. In a continuous delignification, the lignocellulosic material is caused to move through the reactor from one end to the other which thereby constitutes a reaction zone. In a batch process, the lignocellulosic material usually in the form of chips or pulp, remains in the reaction vessel throughout the delignification.

Since the oxygen and carbon monoxide that are employed as essential components in the delignification process of the invention are both gases, the so-called gas phase digestion procedure can be used to advantage. In this case, the wood and the film of delignification liquor present on the wood are kept in continuous contact with the oxygen- and carbon monoxidecontaining gas. If the wood is completely or substantially immersed in the delignification liquor, it is important to agitate the wood and/or the gas and/or atomize the gas or the liquor. The oxygen and carbon monoxide should be dissolved or dispersed in the delignification liquor to the greatest extent possible. Dissolution or dispersion of oxygen and carbon monoxide in the liquor can take place within the reactor and/or externally of the same, such as in nozzles, containers or other known devices used for dissolving or dispersing gases in liquids.

In application to wood in chip form, the cooking liquor can be allowed to run continuously or intermittently over the chips during the delignification process. In the case of pulped lignocellulosic material with the fibers exposed, such as chemical pulp, sulphate pulp, semichemical or mechanical pulp, one can impregnate the pulp with a solution containing active alkali, remove excess solution, by draining and/or pressing operations, and then subject the pulp to the delignification process.

The method can also be applied to a slurry of the lignocellulosic material in the delignification liquid, while the material is in intimate contact with oxygen under pressure.

Transfer of oxygen and carbon monoxide to the delignification material impregnated with delignification liquor is important in the process, and is controlled by adjusting the oxygen and carbon monoxide partial pressures, the delignification temperature and/or or the proportion of gas-liquid contact surfaces, including the wood impregnated with delignification liquor.

The oxygen is preferably employed as pure oxygen, but mixtures of oxygen with other inert gases can be used, such as, for example, mixtures of oxygen with nitrogen and with carbon dioxide and with both, as well as air. Compressed air can also be used, although this complicates the devices for dissolving or dispersing the oxygen in the reaction mixture.

The partial pressure of oxygen can be as low as 1 bar, although under normal conditions it is most advantageous to use a pressure of at least 5 bars. When the method is applied to non-defibrated wood chips or similar types of wood fragments, e.g., sticks or shavings or sliced wood chips, it is suitable to maintain an oxygen pressure of at least 10 bars. A strong reduction in the shive content and an improvement in the selectivity is obtained at higher oxygen pressures, such as pressures within the range from about 12 to about 100 bars. The best results at reasonable apparatus costs are obtained within the range from about 20 to about 40 bars, within which range the shive content is surprisingly low in comparison with parallel tests at 5 bars pressure.

The carbon monoxide can be added by blending with the oxygen gas phase before entering the delignification system, but of course carbon monoxide formed in situ is always entering the gas phase in the course of the delignification. Thus, a gas phase from a previous delignification stage or parallel delignification system is an excellent source of carbon-monoxide-containing oxygen gas phase, as indicated previously.

A large amount of carbon monoxide is formed in the course of oxygen gas alkaline delignification of lignocellulosic material, especially when bleaching in the presence of sodium hydroxide. Control the amount of carbon monoxide formed in this way makes it possible to control the concentratin of carbon monoxide in the gas phase of the delignification system. The formation of carbon monoxide is substantially proportional to the decrease in the lignin content of the cellulosic material, and it is also dependent on delignification temperature. The amount of carbon monoxide for a given reduction in lignin content is greater, the higher the temperature of the delignification.

The delignification process is in itself exothermic, but temperatures which cannot be reached as a result of the exothermic heat of reaction can be reached by applying external heat during the delignification, for example, in the form of steam. The exothermic heat of reaction reaches between 10.000 and 25,000 Kilojoules per gram of dissolved lignin, when the reaction conditions are maintained within the range from 0.3 to 1.5 MPa, and about 90° to about 150° C. Excessively high delignification temperatures should be avoided, since they may result in an impaired selectivity, reflected in an inability to decompose the cellulose chains of the lignocellulosic material to the desired extent.

In the digestion of lignocellulosic material, during the major part of the oxygen-alkali delignification process, the temperature should be maintained within the range from about 100° to about 170° C. At temperatures within the range from 100° to 120° C, the reaction is slow. The preferred temperature range is from about 80° to 160° C, still more preferably from about 120° to about 150° C. A temperature from 80° to 140° C is particularly suitable for the treatment of lignocellulosic material having a low lignin content, e.g. wood cellulose of the sulphate or sulphite pulp type.

Pulps for a certain field of use, for example, for use in the production of paper, should have a high degree of strength. In such cases, it is suitable to carry out the delignification in the presence of an inhibitor or mixture of inhibitors which protect the cellulose and hemicellulose molecules against uncontrolled degradation. The effect of the inhibitors is reflected by the viscosity of the pulp, and the degree of polymerization of the cellulose.

The inhibitors can to advantage be charged to the delignification liquor during an early stage of the delignification or, preferably, before the delignification is begun. Thus, they can be added to the delignification liquor before combination with the lignocellulosic material, e.g. with pulp or wood. They can also be impregnated into the lignocellulosic material before the delignification liquor is added.

Magnesium compounds as is well known are highly effective in inhibiting the decomposition of cellulose during an oxygen gas-alkali delignification process. Frequently, magnesium compounds cannot be used in combination with other inhibitors because the general effect is an impairment of the inhibiting effect of the magnesium compounds. This is not the case, however, when carbon monoxide and/or manganese are present, and consequently, carbon monoxide and also manganese can with advantage be combined with magnesium compounds, giving an overall increase in selectivity during delignification. The inhibiting effect of the magnesium compound is particularly noticeable at delignifications carried out at a relatively high pH, when sodium hydroxide is used as the active alkali, as compared to lower pH processes, when sodium carbonate and/or bicarbonate or mixtures thereof with sodium hydroxide are used as the active alkali.

Suitable inhibitors are water-insoluble magnesium compounds, such as magnesium carbonate. Magnesium carbonate is known, and is disclosed in U.S. Pat. No, 3,384,533 to Robert et al dated May 21, 1968, as useful in the delignification and bleaching of cellulose pulps with alkali and oxygen, but this is not a digestion of wood. Other water-insoluble magnesium compounds such as magnesium oxide and hydroxide are disclosed in U.S. Pat. No. 3,657,068 patented Apr. 18, 1972 to L'Air Liquide, also relating to alkaline oxygen bleaching of cellulose pulps. Also useful are water-soluble magnesium compounds such as magnesium chloride or magnesium acetate, which form water-insoluble magnesium compounds in the alkaline digestion liquor such as magnesium hydroxide or magnesium carbonate, and therefore exist as such insoluble compounds after the digestion. These are also disclosed in U.S. Pat. No. 3,657,068. However, magnesium compounds which are soluble in the digestion liquor in the course of the digestion process are preferred. Such water-soluble magnesium compounds are disclosed in U.S. Pat. Nos. 3,652,385 and 3,652,386, both patented Mar. 28, 1972, the disclosures of which are hereby incorporated by reference.

After the oxygen delignification process has been completed, the pulp may optionally be subjected to a mechanical treatment in order to liberate the fibers. If the pulping is brief or moderate, a defibrator, disintegrator, or shredder may be appropriate. After an extensive or more complete pulping or delignification, the wood can be defibrated in the same manner as in other conventional cellulose cooking processes, such as sulfate pulping, by blowing off the material from the digester, or by pumping.

The pulped wood cellulose that is obtained in accordance with the process of the invention is of such whiteness that it can be used to advantage directly for producing tissue paper, light cardboard and magazine paper. When a higher degree of brightness is desired, as for fine paper, rayon and cellulose derivatives, the pulp can easily be bleached in accordance with known methods by treatment with chlorine, chloride dioxide, chlorite, hypochlorite, peroxide, peracetate, oxygen or any combinations of these bleaching agents in one or more bleaching sequences as described in for example U.S. Pat. No. 3,652,388, patented Mar. 20, 1972. Chlorine dioxide has been found to be a particularly suitable bleaching agent for the oxygen digested cellulose pulp obtained in accordance with this invention. The consumption of bleaching chemicals is generally markedly lower in bleaching oxygen pulps of the invention than when bleaching sulfate cellulose.

The chemicals used for the digestion process can be recovered after the waste liquor is burned and subsequent to optionally causticizing all or part of the carbonate obtained when burning the liquor.

The drawing shows an apparatus including a delignification reactor 1 and a catalytic reactor 6 in which the carbon monoxide withdrawn from the delignification reactor can be catalytically oxidized to carbon dioxide. The catalytic reactor 6 is in fluid flow communication with the delignification reactor 1 by way of lines 3, 5, on the inlet side of the reactor 6, and lines 7,8 on the outlet side of the reactor 6. In addition, a by-pass line 10 is provided, by-passing the pressure vessel 6, and two bleed lines, line 4 for the reactor 1, and line 9 for the reactor 6. The fan 12 drives the gases from lines 7, 10 through line 9 or line 8 to the reactor 1.

Within the reactor 6 is a catalyst bed 11, for converting carbon monoxide to carbon dioxide, such as, for example, platinum metal adsorbed on alumina. Gases led out of the delignification reactor 1 by way of lines 3, 5 to the reactor 6 must pass through the catalyst bed, in order to reach the outlet lines 7, 8 and return to reactor 1.

The bleed lines 4, 9 make it possible to bleed off the gas phase including carbon dioxide, oxygen gas and other gases from the system, either before or after CO conversion to $CO_2$. In addition, the gas phase can be arranged to by-pass the reactor 6 by way of the by-pass line 10 in whole or in part, so that the necessary carbon monoxide concentration can be maintained in the delignification reactor 1.

The delignification reactor 1 is also provided with an inlet line 2 for entry of fresh oxygen gas or oxygen gas phase.

In operation, the reactor 1 is filled with lignocellulosic material to be delignified, such as wood chips, or cellulose pulp. The material can be flowed continuously through the reactor, entering at the top, and leaving at the bottom in the flow direction indicated by the arrows. The oxygen gas phase recycled from reactor 6 or line 10 (and line 3, fan 12 and line 8) enters via the inlet at the bottom, together with any replenishing oxygen gas phase entering via line 2, and passes upwardly in countercurrent flow to the material in downflow through the reactor. The oxygen gas phase is withdrawn via line 3 at the top, and all or part passed through the line 10 or the reactor 6 for CO conversion to $CO_2$, the resulting gas passing back to the reactor 1 via fan 12 and line 8. From time to time, or continuously, or not at all, gas may be bled off via lines 4 or 9, as required to maintain CO concentration in the reactor 1.

The apparatus according to the invention and shown in the FIGURE is adapted to control the formation of carbon monoxide during the actual delignification process, in order to maintain the carbon monoxide content within the desired limits. This control utilizes the principle that during the oxygen-gas delignification of lignocellulosic material, the amount of carbon monoxide formed is substantially proportional to the decrease in the lignin content of the lignocellulosic material. The amount of carbon monoxide is also dependent on temperature; for a given reduction in the lignin content, the amount of carbon monoxide increases as the temperature of the delignification process increases, as indicated previously.

Since the exothermic heat of reaction during the delignification process is substantially proportional to the degree of delignification, a reduction in a lignin content within the range from about 15 to about 20% to within the range from about 3 to about 6%, calculated on the dry weight of lignocellulosic material, would be impossible if no form of temperature control was provided, at least in reactors for processing at high pulp concentrations.

Accordingly, the apparatus of the FIGURE is provided with means for controlling the temperature in the delignification reactor. Thus, the carbon monoxide content of the oxygen gas phase in the delignification system containing carbon monoxide and oxygen is controlled. The apparatus accordingly has means for passing a stream of gas through the delignification reactor. The stream can be either hot or cold, as required, to supply or remove heat and thereby obtain the desired temperature control. The gas so introduced can be replenishing oxygen gas and/or carbon monoxide gas, or a waste gas from some other delignification system, such as conveniently, a circulating digester or bleaching gas, comprising mainly oxygen gas.

Such control is of particular significance when the lignocellulosic material to be treated has a high lignin content, which can give rise to a high carbon monoxide content in the oxygen gas phase of the system.

It has also been found that any disadvantageous effect of high temperature on the delignification selectivity is particularly noticeable at carbon monoxide contents in excess of 4% by volume. It is therefore of particular importance that the temperature be controlled and the temperature held down, to realize the inhibiting effect when carbon monoxide has on the decomposition of cellulose.

The temperature regulating effect is obtained by regulating the temperature and the partial pressure of water vapor in the gas entering the delignification reactor 1 via the line 8. If the partial pressure of the water vapor in the gas entering the reaction vessel is lower than the partial pressure corresponding to the pressure and temperature prevailing in the reactor, the temperature in the reactor will be lowered, owing to the fact that part of the water in the reactor will be converted into steam. In addition, if the gas entering the reactor has a lower temperature than that prevailing in the reactor, the delignification temperature is further lowered.

Conventional heat exchangers may be used to cool the gas entering the reactor. To reduce the partial pressure of the gas, in addition to cooling the gas, it is particularly convenient to reduce the pressure in the gas line by constricting the line, so that the condensation pressure is reduced to below that for the existing temperature of the steam, which results in part of the steam condensing out as water. This water can then be separated from the system, for example by means of cyclone separators. The gas is then passed via a pressure-raising means into the reactor.

To apply this technique, the gas-circulation apparatus of the Figure has a pressure-reducing valve (not shown in the Figure) in front of the fan 12 by means of which valve the pressure is lowered and the condensed water separated in the by-pass line 10 or in the line 7 or in both of these lines or in the joint line to the fan. The method, however, is not restricted to the gas-circulation circuit shown in the drawing, but can be used in any delignification system, for temperature and vapor pressure control. Another way of doing this is to restrict the gas flow in one or more restricted zones of the bed of lignocellulosic material in the reactor 1.

From the point of view of controlling the carbon monoxide content and temperature, the most suitable method in practice is to remove all or part of the gas phase in the delignification reactor at the top of the reactor, and to recycle all or part of the gas phase to the bottom of said reactor, thereby passing a stream of gas in countercurrent flow to the direction of flow off the lignocellulosic material through the reactor. Such countercurrent flow of the gas makes it possible to reduce, and under certain conditions to eliminate, the need for supplying additional heat during the oxygen-gas-alkali delignification process.

Normally, the lignocellulosic material must be heated to a temperature within the range from about 90° to about 140° C before commencing the delignification. Such heat is provided by means of low-or high-pressure steam, or by both. Since the exothermic heat of reaction of the delignification can be transferred either wholly or in part to the circulating gas stream, it has been found that the heated gas can be used for heating the lignocellulosic material entering the reactor, which correspondingly reduces the amount of steam needed to heat the lignocellulosic material. If a suitable balance is achieved in the reduction of the lignin content of the lignocellulosic material, and the temperatures of the lignocellulosic material entering the reactor and the circulating gas flow, both the external supply of steam and the beforementioned external gas-cooling method can be unnecessary, thereby affording a considerable economic advantage.

Another advantage of the countercurrent flow circulation of gas to lignocellulosic material is that the gas pore volume which is so important most oxygen-gas delignification processes (i.e., the open volume in the bed of lignocellulosic material that is available for gas flow) is increased. This factor is of greatest importance in high consistency bleaching of pulp carried out at a pulp consistency within the range for instance from about 20% to about 40%, preferably from about 25 to about 35%. This can be helpful in the efficient design of the reactor. Hitherto, the height of the bed of lignocellulosic material has been a critical limiting factor in the size of the majority of oxygen-gas delignification reactors. If the height of the bed exceeds a critical maximum that is proportional to the pulp concentration, the static load on the fibers at the bottom of the bed is so great that liquid is forced out of the fibers. This greatly reduces the porosity of the bed, thereby inhibiting penetration of the bed by oxygen gas. However, a countercurrent upward flow of gas for temperature control purposes relieves the static load on the bottom layers of the bed. This relief of the static load is obtained as a result of the pressure drop across the bed of the upward flow of gas. The greater the rate of flow of the gas, the greater the drop in pressure. By utilizing this load-relieving effect, the height of the bed in the oxygen-gas reactor can be increased, thereby affording a considerable economic advantage in the construction of the reactor.

In addition, the method according to the present invention affords the important advantage that the risk of possible fire and explosion during an oxygen-gas delignification process is eliminated. By limiting the increase in temperature during delignification, the temperature does not reach the self-ignition temperature of flammable compounds such as fatty acids and turpentine that may be present.

The following Examples represent preferred embodiments of which Examples 1 to 6 illustrate the protective effect of different concentrations of carbon monoxide within the limits of the present invention and Examples 7 to 16 illustrated the process of the present invention used in bleaching and Examples 17 in cooking.

EXAMPLES 1 to 3

A pine sulphate pulp having a Kappa number of 28.6 (according to SCAN) and an intrinsic viscosity of 1153 $dm^3kg$ (according to SCAN) was divided into six portions, each of which was bleached with oxygen gas under a superatmospheric pressure of 600 kPa for 45 minutes at 100° C and a pulp concentration of 28.9 to 29.2% by weight. The alkali used was NaOH, in amounts ranging from 2 to 3% by weight, calculated on an absolutely dry unbleached pulp. The same amount of bleaching waste liquor (0.7 $dm^3$ per kg pulp) containing dissolved magnesium was added to each portion; the quantity of Mg was thus 0.2% by weight of the dry weight of the pulp. In Examples 1 to 3, the bleaching was carried out in the presence of 3% by volume carbon monoxide in the gas phase. In Controls A to C, the carbon monoxide concentration of the gas phase was below 0.5% by volume.

The results are shown in Table I.

TABLE I

| EXAMPLE | CO VOLUME % | Kappa number | Viscosity ($dm^3$/kg) |
|---|---|---|---|
| 1 | 3 | 15.5 | 1022 |
| Control A | <0.5 | 16.0 | 981 |
| 2 | 3 | 13.9 | 973 |
| Control B | <0.5 | 14.3 | 950 |
| 3 | 3 | 13.7 | 967 |
| Control C | <0.5 | 13.0 | 920 |

The results show that, compared at the same Kappa number (Example 1 vs A, Example 2 vs B, Example 3 vs C) the viscosity was 30 to 50 units higher when CO was present.

EXAMPLES 4 to 6

A pine sulphate pulp having a Kappa number of 28.6 (according to SCAN) and an intrinsic viscosity of 1153 $dm^3$/kg (according to SCAN) was divided into six portions, each of which was bleached with oxygen gas under a superatmospheric pressure of 600 kPa for 45 minutes at 100° C and a pulp concentration of 28.9 to 29.2% by weight. The alkali used was NaOH, in amounts ranging from 2 to 3% by weight, calculated on an absolutely dry unbleached pulp. The same amount of black liquor, 4% by weight, and of bleaching waste liquor (0.7 $dm^3$ per kg pulp) containing dissolved magnesium was added to each portion; the quantity of Mg was thus 0.2% by weight of the dry weight of the pulp. In Examples 4 to 6, the bleaching was carried out in the presence of 3% by volume carbon monoxide in the gas phase. In Controls D to F, the carbon monoxide concentration of the gas phase was below 0.5% by volume.

The results are shown in Table II.

TABLE II

| EXAMPLE | CO VOLUME % | Kappa number | Viscosity ($dm^3$/kg) |
|---|---|---|---|
| 4 | 3 | 16.6 | 1028 |
| Control D | <0.5 | 16.2 | 985 |
| 5 | 3 | 14.2 | 978 |
| Control E | <0.5 | 13.3 | 936 |
| 6 | 3 | 12.2 | 928 |
| Control F | <0.5 | 12.3 | 904 |

The results show that, compared at the same Kappa number (Example 4 vs D, Example 5 vs E, Example 6 vs F) the viscosity was 30 to 50 units higher when CO was present.

EXAMPLE 7

Unbleached pine sulphate was impregnated with waste liquor containing dissolved magnesium from an oxygen-gas bleaching stage and then with sodium hydroxide solution and pressed to a pulp concentration of 30%. The sodium hydroxide was charged in a quantity corresponding to 1.7% and the magnesium corresponding to 0.5% of the weight of the pulp.

Four tons per hour of this pretreated pulp were charged to the top of a continuously-operating delignification reactor in the apparatus shown in the Figure, arranged for oxygen-gas bleaching. The pulp was passed by gravity downwardly through the reactor. Pure oxygen gas was charged to the bottom of the reactor to maintain the pressure in the reactor at 700 kPa. The temperature in the reactor was 100° C. The residence time for the pulp was 30 minutes. The carbon monoxide concentration in the reactor increased linearly, from an initial value of zero at start-up to 7% by volume after 17 hours of operation. The carbon monoxide concentration was then maintained constant at 7% by volume, by bleeding off gas phase through line 4. The Kappa number of the ingoing pulp was 30 to 33, and of the outgoing pulp 14 to 16. A study of the viscosity as a function of the Kappa number and carbon monoxide concentration showed that when the carbon monoxide concentration was 7% by volume, the viscosity was an average of 60 $dm^3$/kg higher than when the gas was practically free from carbon monoxide.

An alternative method of operation that concerves oxygen is to remove carbon monoxide and recycle the resulting oxygen gas phase. This can be done by cycling all or a part of the gas phase withdrawn from the reactor via lines 3, 5 through the catalytic reactor 6 containing a bed of platinum catalyst or alumina carrier (COEX 0.3) converting carbon monoxide to carbon dioxide, returning the resulting oxygen gas mixture via line 8 to reactor 1.

EXAMPLE 8

Unbleached and unpretreated pine sulphate pulp having a lignin content of 11 to 13%, calculated on the lignocellulosic material, was fed to a continuously operating reactor as shown in the Figure at the rate of four tons per hour. The carbon monoxide concentration of the reactor increased more rapidly than with a corresponding infeed of pulp having a Kappa number of 30to 33, corresponding to a lignin content of 4 to 5%, as described in Example 7.

After only four hours of operation, the carbon monoxide concentration increased from 0% to 7% by volume. The carbon monoxide concentration at the top of the reactor could be maintained constant by bleeding gas from the top of the reactor via line 4, and by simultaneously increasing the amount of pure oxygen gas fed to the bottom of the reactor via line 2. By subsequently cooling the gas charged to the bottom of the reactor, it was possible to gradually reduce the carbon monoxide concentration of the gas phase in the reactor by 4% by volume.

An alternative method of operation that conserves oxygen is to remove carbon monoxide and recycle the resulting oxygen gas phase. This can be done by cycling all or a part of the gas phase withdrawn from the reactor via lines 3, 5 through the catalytic reactor 6 containing a bed of platinum catalyst or alumina carrier (COEX 0.3) converting carbon monoxide to carbon dioxide, returning the resulting oxygen gas mixture via line 8 to reactor 1.

In the course of the delignification, the temperature of the pulp bed in the reactor was also noted. At start-up, the temperature of the pulp bed as introduced into the reactor was 95° C. (The pulp had been preheated by passage through a stream mixer.) Immediately after starting up, the temperature measured in the uppermost layer of the pulp bed in the reactor was 105° C, and the temperature within the remainder of the pulp bed was 140° C. After the adjustment of the carbon monoxide concentration, these temperatures were found to be 115° and 127° C, respectively. The hotter portion of the pulp bed had thus been cooled, such that the temperature within the bed had decreased from 140° to 127° C, while the temperature in the cooler layer of the pulp bed had increased, from 150° to 115° C.

By reducing the flow of steam to the steam mixer, located upstream of the reactor vessel, the temperature of the pulp entering the reactor vessel was reduced to 85° C. The temperature of the pulp located in the upper strata of the bed and within the bed then also decreased to 107° and 118° C, respectively. The reduction in the flow of steam to the stream mixer together with the cooling of the gas passed to the reactor resulted in reducing the carbon monoxide concentration in the gas phase to 4% by volume.

The lignin content of the outgoing pulp was from 4.5 to 6%, calculated on the lignocellulosic material. Samples were taken of the pulp which passed through the reaction vessel immediately after start-up. The bleaching gas was at this point practically free from carbon monoxide and the temperature in the pulp bed was in excess of 135° C. A comparison was then made between these samples and samples taken when the carbon monoxide reached 4% by volume. The viscosity of the latter samples was, on average, 70 dm³/kg higher than the viscosity of the pulp according to the former samples.

EXAMPLES 9 to 16

Unbleached pine sulfate pulp having a Kappa number of 30 to 33 SCAN and an intrinsic viscosity of 1153 dm³/kg SCAN was impregnated with waste liquor from an oxygen gas bleaching stage containing magnesium ions and complex-forming hydroxycarboxylic acids, and then with sodium hydroxide solution, and pressed to a pulp concentration of 30%. The sodium hydroxide was charged in a quantity corresponding to 1.7% and the magnesium in a quantity corresponding to 0.5% of the weight of the pulp. The Kappa number of the outgoing pulp was 14 to 15.

Four tons per hour of this pretreated pulp were charged to the top of a continuously-operating delignification reactor in the apparatus shown in the Figure, arranged for oxygen gas bleaching. The pulp was passed by gravity downwardly through the reactor. Oxygen gas having a purity of 99.5% by volume was charged to the bottom of the reactor to maintain the pressure in the reactor at 700KPa. The temperature in the reactor was kept at 100° C. The residence time for the pulp was 30 minutes. The carbon monoxide concentration in the reactor increased linearly from an initial value of zero at start-up to 7% by volume after 17 hours of operation.

In order to maintain and investigate the effect of different oxygen and carbon monoxide concentrations in the reactor, oxygen and carbon monoxide gas together with inert gases emanating from incoming pulp was withdrawn through line 3. In order to prevent enrichment of inert gases a small part of the gas mixture was vented through line 4. Different portions of the remaining gas mixture in line 5 were drawn partly through the catalytic reactor 6 containing a bed 11 of a platinum catalyst on alumina carrier (COEX 0.3) in which 90% of the ingoing carbon monoxide was catalytically oxidized to carbon dioxide, after which the remaining gas mixture was returned via the fan 12 and the line 8 back to the reactor 1, and partly through the line 10 via the fan 12 and the line 8 back to the reactor 1. The flow of oxygen-containing gas in the line 8 was kept at 25 cubic meters per ton of pulp. The viscosity of the outgoing pulp was analyzed. The conditions used and the corresponding results are shown in Table III in which all gas flows are given in cubic meters per ton of pulp at normal temperature and pressure (NTP).

TABLE III

| Example number | Gas flow in line 4 | Gas flow in line 10 | Gas flow in line 7 | CO-concentration in line 3 % by volume | Viscosity of pulp dm³/kg SCAN |
|---|---|---|---|---|---|
| 9 | 1.6 | 17.5 | 7.5 | 3.0 | 1028 |
| 10 | 2.1 | 17.5 | 7.5 | 2.6 | 1024 |
| 11 | 1.6 | 10.0 | 15.0 | 1.7 | 1017 |
| 12 | 2.1 | 10.0 | 15.0 | 1.5 | 1018 |
| 13 | 5.0 | 0 | 0 | 4.8 | 981 |
| 14 | 6.0 | 0 | 0 | 4.0 | 970 |
| 15 | 14.0 | 0 | 0 | 1.7 | 967 |
| 16 | 22.0 | 0 | 0 | 1.1 | 953 |

As is seen from the Table, in Examples 13 to 16, when all of the gas mixture leaving the top of the reactor was purged through line 4, and nothing recirculted to the reactor 1, the viscosity was considerably less than in Examples 9 to 12, in which the main part of the gas mixture leaving the top of the reactor was returned to the reactor. This is explained by the fact that pure oxygen gas is introduced through line 2 at the bottom of the reactor, and that consequently the concentration of carbon monoxide in the bottom of the reactor is low, giving much lower selectivity than in Examples 9 to 12 according to the invention, in which carbon monoxide-containing gas was returned to the reactor through the line 8. Examples 9 and 10, in which about 30% of the gas-mixture leaving the top of the reactor was drawn through the catalytic reactor and only a small part purged through the line 4, resulted in a higher carbon monxide concentration in the reactor than in Examples 11 and 12, in which 60% of the gas mixture in line 5 was treated in the catalytic reactor, and consequently the viscosity was higher.

EXAMPLE 17

Sliced birch chips of the average dimensions 1.5 × 10 × 35 mm produced from industrial birch chips were pretreated by heating at 160° C with an aqueous solution of $NaHCO_3$ at a wood:liquor ratio of 1:5 for two hours. The bicarbonate solution contained EDTA (NA-salt). The $NaHCO_3$ charge corresponded to 20% by weight, and the EDTA to 0.1% by weight, both based on the dry weight of the wood.

An oxygen cooking process was effected at a partial pressure of oxygen of 1.5 MPa by means of a spraying method, aqueous sodium bicarbonate solution being sprayed and circulated over the pretreated chips at 140° C. The wood:liquor ratio was 1:14. At the beginning of the oxygen cooking the bicarbonate charge was 2.1% $NaHCO_3$, based on the dry weight of the wood. The pH was maintained at from 6.8 to 7.2 during the entire cooking operation, by injecting aqueous sodium bicarbonate solution.

With the addition of 0.2% Mn as manganous sulfate based on the dry weight of the wood impregnated into the chips before the oxygen cooking, a pulp having a Kappa number 12.6 and a viscosity of 920 $dm^3/kg$ SCAN was obtained after oxygen cooking for 3.5 hours at a concentration of 4% (by volume) carbon monoxide in the gas phase. The carbon monoxide was added to the oxygen introduced into the digester to simulate the transfer of carbon monoxide-containing oxygen from an oxygen bleaching reactor to a reactor for oxygen digestion of wood.

After four hours of cooking the Kappa number was 8.4, and the viscosity 870 $dm^3/kg$. Controls with the same pretreated and manganese-impregnated chips without addition of carbon monoxide gave pulps with a Kappa number of 12.7 and a viscosity of 880 $dm^3/kg$ after 3.5 hours, and a Kappa number 8.3 and a viscosity of 830 $dm^3/kg$ after 4 hours. In these controls, the gas phase contained less than 0.5% carbon monoxide during the entire cooking period.

As the results show, the method according to the invention leads to an improved selectivity in the delignification, i.e. a higher viscosity at a given lignin content.

Having regard to the foregoing disclosure, the following is claimed as inventive and patentable embodiments thereof:

1. A process for the delignification of lignocellulosic material which comprises carrying out the delignification with oxygen gas and alkali in the presence of a gas phase comprising oxygen gas and carbon monoxide wherein the carbon monoxide is in a concentration within the range from about 1% to about 12% by volume of the gas phase while maintaining the carbon monoxide concentration within said range by withdrawing carbon monoxide and oxygen gas from the delignification, and separating and recycling withdrawn oxygen gas.

2. A process according to claim 1, in which the amount of carbon monoxide is at most 90% of the concentration corresponding to the explosion limit of the oxygen-containing gas.

3. A process according to claim 1, in which the amount of carbon monoxide is within the range from about 2% to about 10% by volume.

4. A process according to claim 1, in which the amount of carbon monoxide is within the range from about 4% to about 9% by volume.

5. A process according to claim 1, which includes flowing the gas phase in contact with a flow of the lignocellulosic material during delignification.

6. A process according to claim 5, in which the gas phase is flowed countercurrently to the lignocellulosic material.

7. A process according to claim 1, in which carbon monoxide is removed from the oxygen gas before recycling.

8. A process according to claim 7, in which the carbon monoxide is removed by absorption or adsorption.

9. A process according to claim 7, in which the carbon monoxide is oxidized to carbon dioxide.

10. A process according to claim 1, in which oxygen and carbon monoxide are removed from the delignification and transferred to another delignification process.

11. A process according to claim 1, in which oxygen and carbon monoxide are removed from a delignification of cellulose pulp and transferred to an oxygen-gas-alkali digestion process.

12. A process according to claim 1, in which the process is carried out at a pH within the range from about 6.5 to about 11 in the presence of an added catalytically active manganese compound in an amount sufficient to improve the selectivity of the delignification and increase the rate of delignification, the manganese compound being added before dissolution of approximately 10% of the lignin content of the starting lignocellulosic material.

13. A process according to claim 12, in which all of the manganese compound is added initially.

14. A process according to claim 12, in which the manganese compound is added incrementally in the course of the delignification.

15. A process according to claim 12, in which the manganese compound is added continuously in the course of the delignification.

16. A process according to claim 12, in which the manganese compound is impregnated into the lignocellulosic material prior to the delignification with oxygen and alkali.

17. A process according to claim 12, in which the manganese compound is a bivalent manganous compound.

18. A process according to claim 17, in which the manganous compound is selected from the group consisting of manganous oxide, manganous chloride, manganous bromide, manganous hydroxide, manganous nitrate, manganous sulfate, manganous carbonate, manganous phosphate, manganous acetate, manganous formate, manganous oxalate, and complex salts of manganous ion with chelating inorganic and organic acids.

19. A process according to claim 12, wherein the manganese compound is added in an amount within the range from about 0.001 to about 2% by weight Mn based on the dry weight of the lignocellulosic material.

20. A process according to claim 1, in which the lignocellulosic material prior to the delignification is washed to remove copper, cobalt and iron which catalyze the degradation of carbohydrates.

21. A process according to claim 20, wherein the lignocellulosic material prior to the delignification is washed with an aqueous solution comprising a metal complexing agent.

22. A process according to claim 20, wherein the lignocellulosic material is washed with hot water.

23. A process according to claim 20 wherein the lignocellulosic material is washed with an aqueous acidic solution comprising an acid.

24. A process according to claim 20 wherein the lignocellulosic material is washed with an aqueous alkaline solution comprising at least one alkali selected from the group consisting of sodium carbonate, sodium bicarbonate and sodium hydroxide

25. A process according to claim 20, wherein the lignocellulosic material is washed with a waste liquor from the oxygen-alkali delignification process.

26. A process according to claim 20, wherein the lignocellulosic material is washed with a member selected from the group consisting of water and acidic and alkaline aqueous solutions.

27. A process according to claim 1, wherein the oxygen-alkali delignification process is effected at an oxygen partial pressure of at least 5 bars.

28. A process according to claim 1, in which the lignocellulosic material is wood in the form of particles having a wood structure, and the oxygen-alkali delignification is carried out at an oxygen partial pressure of at least 10 bars.

29. A process according to claim 1, wherein the delignification is carried out at a temperature within the range from about 80° to about 160° C.

30. A process according to claim 1, in which the lignocellulosic material is wood in the form of particles having a wood structure, and the temperature is maintained within the range from about 80° to about 150° C during the delignification.

31. A process according to claim 1, wherein a magnesium compound is added as a cellulose degradation inhibitor.

32. A process according to claim 1, in which the amount of carbon monoxide is maintained within said range by delignification at a temperature within the range from about 90° C to about 150° C.

33. A process according to claim 32, in which exothermic heat of reaction is carried off by flowing a gas through a bed of the lignocellulosic material during the delignification.

34. A process according to claim 33, in which the gas is flowed countercurrently to a flow of the lignocellulosic material.

35. A process according to claim 33, in which the temperature of the gas is maintained below the temperature of the delignification.

36. A process according to claim 33, in which the partial pressure of water vapor in the gas introduced into the bed is maintained below the partial pressure of water vapor in the gas in the bed.

37. A process according to claim 33, in which the oxygen gas and carbon monoxide are removed from the delignification, cooled and recycled to the delignification.

* * * * *

UNITED STATES PATENT OFFICE

CERTIFICATE OF CORRECTION

Patent No. 4,050,981 Dated September 27, 1977

Inventor(s) Allan Geoffrey Jamieson, et al.

It is certified that error appears in the above-identified patent and that said Letters Patent are hereby corrected as shown below:

| | |
|---|---|
| Face Page, Column 2, line 2 : | "Yam" should be --Yang--. |
| Face Page, Column 2, line 13: | "Larducci" should be --Landucci-- |
| Column 2, line 67: | "reachions" should be --reactions-- |
| Column 3, line 17: | "from" should be --form-- |
| Column 3, line 40: | "is" should be --in-- |
| Column 4, line 57: | "trail" should be --trial-- |
| Column 6, line 42: | "is" first occurrence should read -- in --. |
| Column 8, line 16: | "from" should be --form-- |
| Column 8, line 35: | "agens" should be --agents-- |
| Column 8, line 46: | "presents" should be --represents-- |
| Column 9, line 44: | "from" should be --form-- |
| Column 9, line 46: | "from" should be --form-- |
| Column 9, line 50: | "selectted" should be --selected-- |
| Column 10, line 31: | "brich" should be --birch-- |
| Column 12, line 42: | "liquiors" should be --liquors-- |

UNITED STATES PATENT OFFICE

CERTIFICATE OF CORRECTION

Patent No. 4,050,981 Dated September 27, 1977

Inventor(s) Allan Geoffrey Jamieson, et al.

It is certified that error appears in the above-identified patent and that said Letters Patent are hereby corrected as shown below:

| | |
|---|---|
| Column 12, line 52: | "Paticularly" should be --Particularly-- |
| Column 13, line 38: | "reporducible" should be --reproducible-- |
| Column 15, line 16: | "alkai" should be --alkali-- |
| Column 15, line 43: | "monoxidecontaining" should be --monoxide-containing-- |
| Column 16, line 3: | delete "or" |
| Column 16, line 38: | "Control" should be --Controlling-- |
| Column 16, line 40: | "concentratin" should be --concentration-- |
| Column 16, line 53: | "10.000" should be --10,000-- |
| Column 20, line 54: | insert after "important" --to-- |
| Column 21, line 30: | "$dm^3kg$" should be --$dm^3/kg$-- |
| Column 22, line 27: | insert after "sulphate" --pulp-- |
| Column 22, line 56: | "concerves" should be --conserves-- |
| Column 23, line 32: | "stream" should be --steam-- |
| Column 23, line 42: | "150°C" should be --105°C-- |

UNITED STATES PATENT OFFICE

CERTIFICATE OF CORRECTION

Patent No. 4,050,981 Dated September 27, 1977

Inventor(s) Allan Geoffrey Jamieson, et al.

It is certified that error appears in the above-identified patent and that said Letters Patent are hereby corrected as shown below:

Column 23, line 49: "stream" should be --steam--

Column 24, line 68: "recirculted" should be --recirculated--

Column 25, line 15: "monxide" should be --monoxide--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*